US007024151B2

(12) United States Patent
Katoh et al.

(10) Patent No.: US 7,024,151 B2
(45) Date of Patent: Apr. 4, 2006

(54) IMAGE FORMING APPARATUS AND TONER STIRRING METHOD

(75) Inventors: Tetsuo Katoh, Yokohama (JP); Takafumi Amano, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 60 days.

(21) Appl. No.: 10/802,051

(22) Filed: Mar. 17, 2004

(65) Prior Publication Data

US 2005/0207794 A1 Sep. 22, 2005

(51) Int. Cl.
*G03G 20/00* (2006.01)

(52) U.S. Cl. ..... 399/359; 399/254; 399/255; 399/256; 399/258; 399/358

(58) Field of Classification Search ..... 399/254, 399/255, 256, 359
See application file for complete search history.

(56) References Cited

U.S. PATENT DOCUMENTS

| | | | | |
|---|---|---|---|---|
| 5,734,957 | A * | 3/1998 | Ogawa et al. | 399/359 |
| 5,881,345 | A * | 3/1999 | Yamane et al. | 399/255 |
| 5,887,224 | A * | 3/1999 | Mizuishi et al. | 399/62 |
| 6,226,490 | B1 * | 5/2001 | Fujita et al. | 399/359 |
| 6,882,816 | B1 * | 4/2005 | Tamai | 399/254 |

FOREIGN PATENT DOCUMENTS

JP 5-341644 A 12/1993

* cited by examiner

*Primary Examiner*—Michael Tokar
*Assistant Examiner*—Crystal L. Wagner

(57) ABSTRACT

The image forming apparatus has a communicating portion from the first chamber 24 to the second chamber 25, and a communicating portion from the first chamber 24 to the third chamber 26, which are separated from each other. With this structure, an active flow of fresh toner into the third chamber 26, where a developer having a low toner ratio and low toner concentration is stirred together with recycle toner during an image forming operation is suppressed.

9 Claims, 6 Drawing Sheets

IMAGE FORMING APPARATUS AND TONER STIRRING METHOD

BACKGROUND OF THE INVENTION

1. Field of the Invention

The present invention relates to an image forming apparatus that forms an image with use of a developer.

2. Description of the Related Art

Image forming apparatus that use a developer including toner form an image, for example, in the following manner. That is, first, an electrostatic latent image is formed on a photosensitive drum serving as an image carrier, and the latent image is developed by a developer unit. Then, the toner image thus obtained is transferred onto a sheet by a transfer portion, and the image is fixed onto the sheet by the fuser.

Of the image forming apparatus, a type which removes toner remaining on the photosensitive drum after transfer of a toner image onto a sheet by a cleaning unit, and recycles collected toner, which is to be called recycle toner hereinafter, is conventionally known.

In connection with the above, for example, a toner recycle mechanism is conventionally known. With this mechanism, recycle toner is returned directly into a developer unit as the recycle toner carried by the collecting mixer provided in the cleaning unit is conveyed by the coupling mixer provided between the cleaning unit and the developer unit.

With the above-described structure, the collected recycle toner is being supplied to the developer unit whenever the collecting mixer and coupling mixer are rotated.

The recycle toner to be re-used contains toner particles from which a unique external additive is partially peeled off, or toner particles to which an external additive peeled off from other particles are attached, or paper dust mixed thereinto. Therefore, as compared to fresh toner whose amount of the external additive is appropriately set, the recycle toner exhibits a slow rising in amount of charge. Further, in case where charging by friction (triboelectrification) caused by stirring is not sufficient, it is possible that the recycle toner is supplied to the photosensitive drummer without being charged at all.

Uncharged toner, when transferred onto a sheet via a photosensitive drum, cause drawbacks such as creating fog in image and scattering of the toner.

BRIEF SUMMARY OF THE INVENTION

According to an aspect of the present invention, there is provided an image forming apparatus comprising: a first chamber including a first mixer and configured to convey a developer containing at least toner in a first direction while stirring the developer and supply the toner to an image carrier; a second chamber including a second mixer and configured to convey at least the developer supplied from the first chamber in a second direction different from the first direction while stirring the developer; a third chamber including a third mixer and configured to convey at least the developer supplied from the first chamber in the second direction while stirring the developer; a fresh toner supply portion located on an upstream side of the second chamber and configured to supply fresh toner; and a recycle toner supply portion located on an upstream side of the third chamber and configured to supply recycle toner collected from a surface of the image carrier.

According to another aspect of the present invention, there is provided a toner stirring method comprising: supplying recycle toner collected from a surface of an image carrier to a recycle toner supply portion; conveying the supplied recycle toner to a merging portion at a first speed while stirring it, thereby charging it to have a predetermined potential; conveying refresh toner supplied to a fresh toner supply portion at a predetermined timing to the merging portion at a second speed which is slower than the first speed while stirring it, thereby charging it to have a predetermined potential; and supplying the recycle toner and the fresh toner that have been conveyed to the merging portion to the surface of the image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERALVIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

Figure 1:
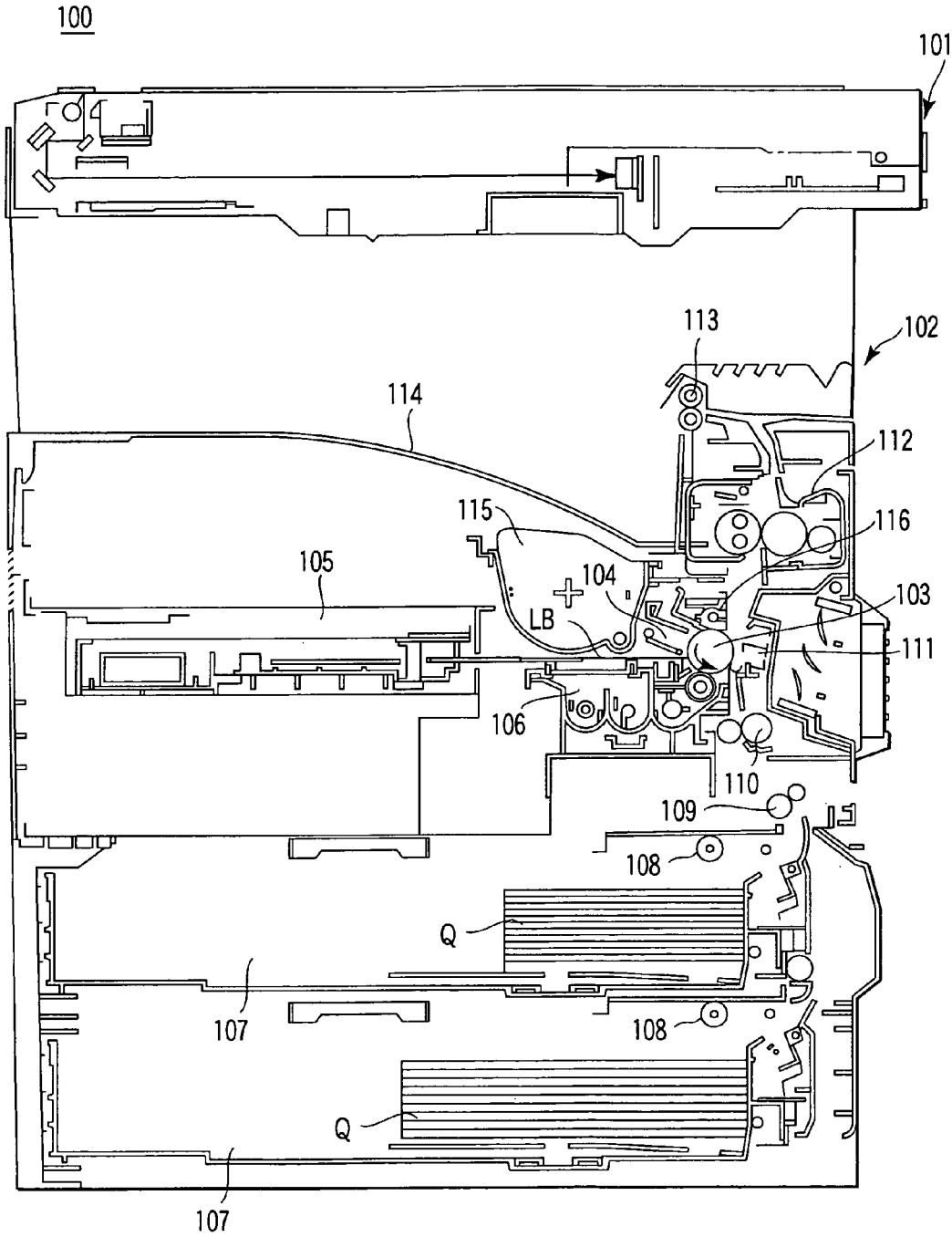
FIG. 1 is a schematic diagram showing an image forming apparatus to which an embodiment of the present invention can be applied.
Figure 2:
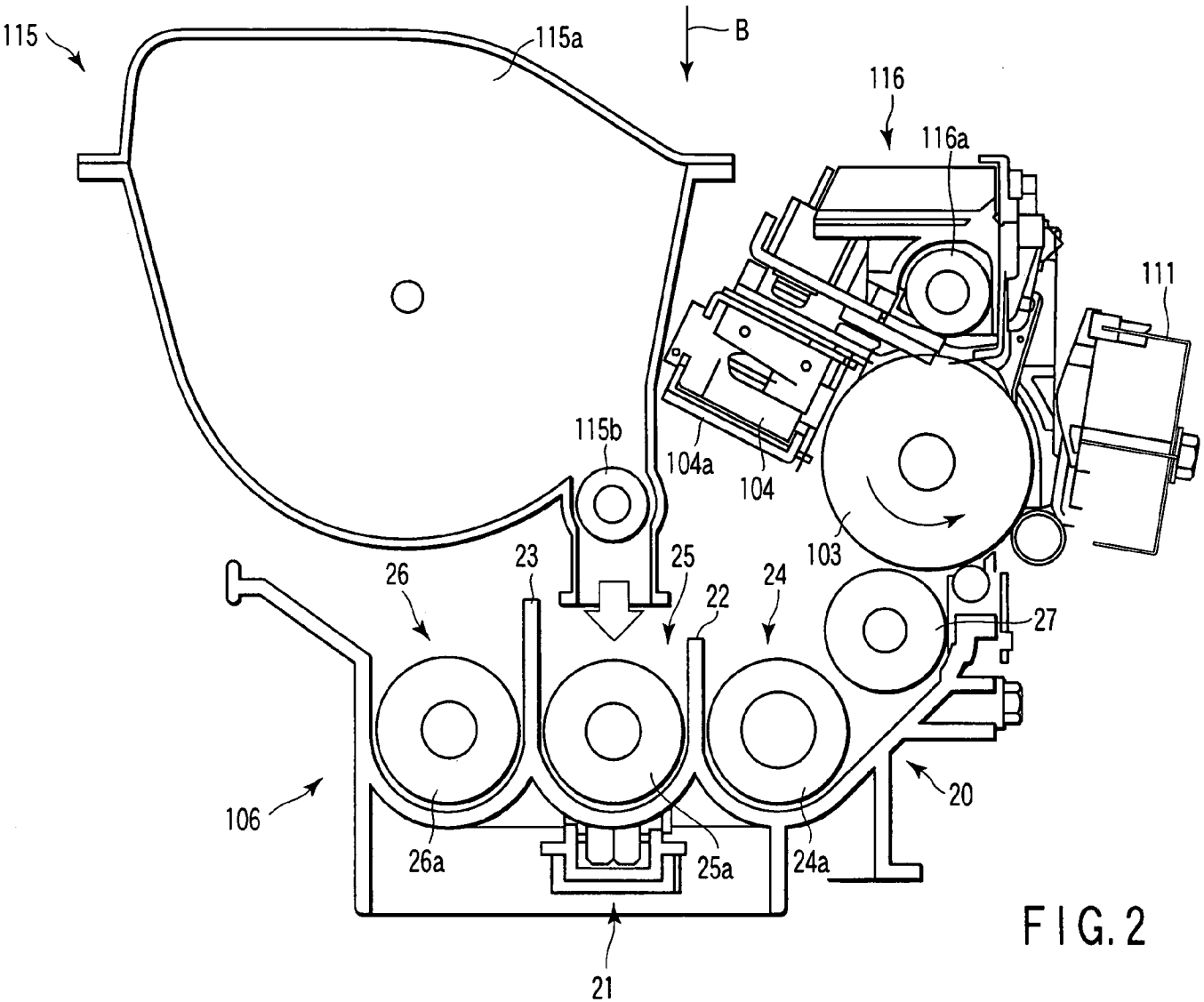
FIG. 2 is a schematic diagram showing a developer unit mounted in the image forming apparatus shown in FIG. 1 and its periphery.
Figure 5A:
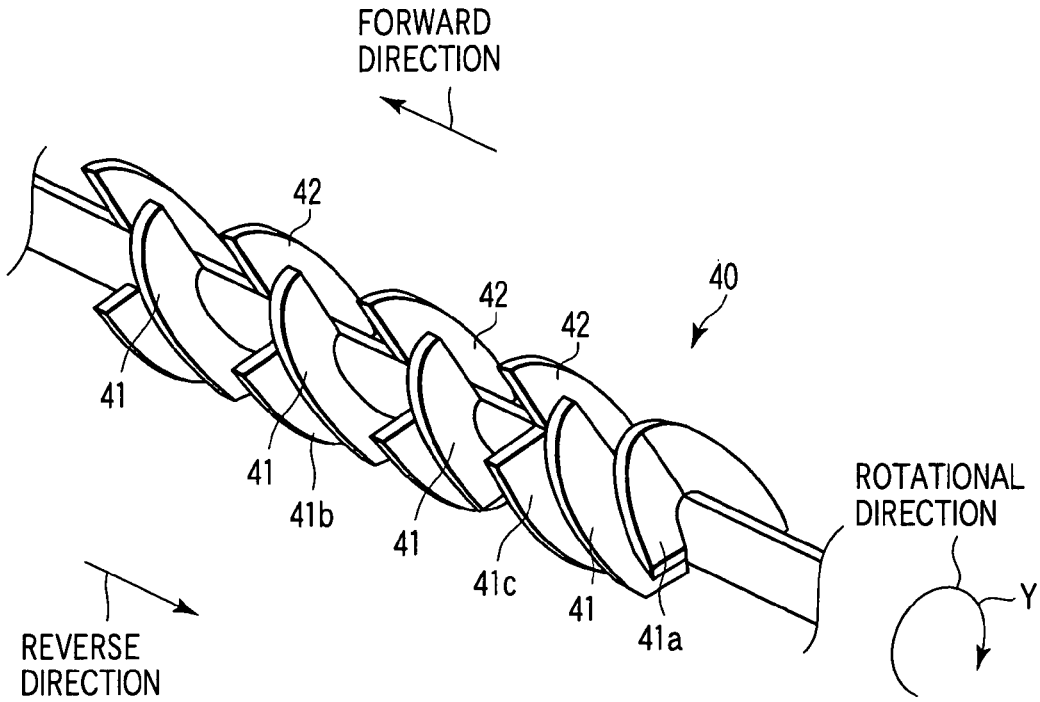
Figure 5B:
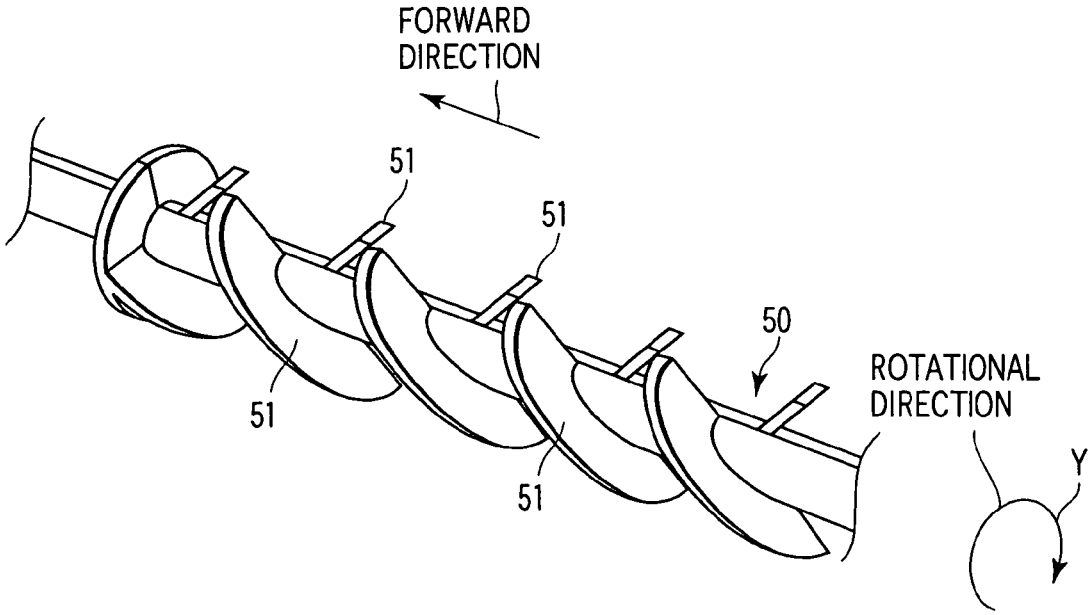
Figure 6:
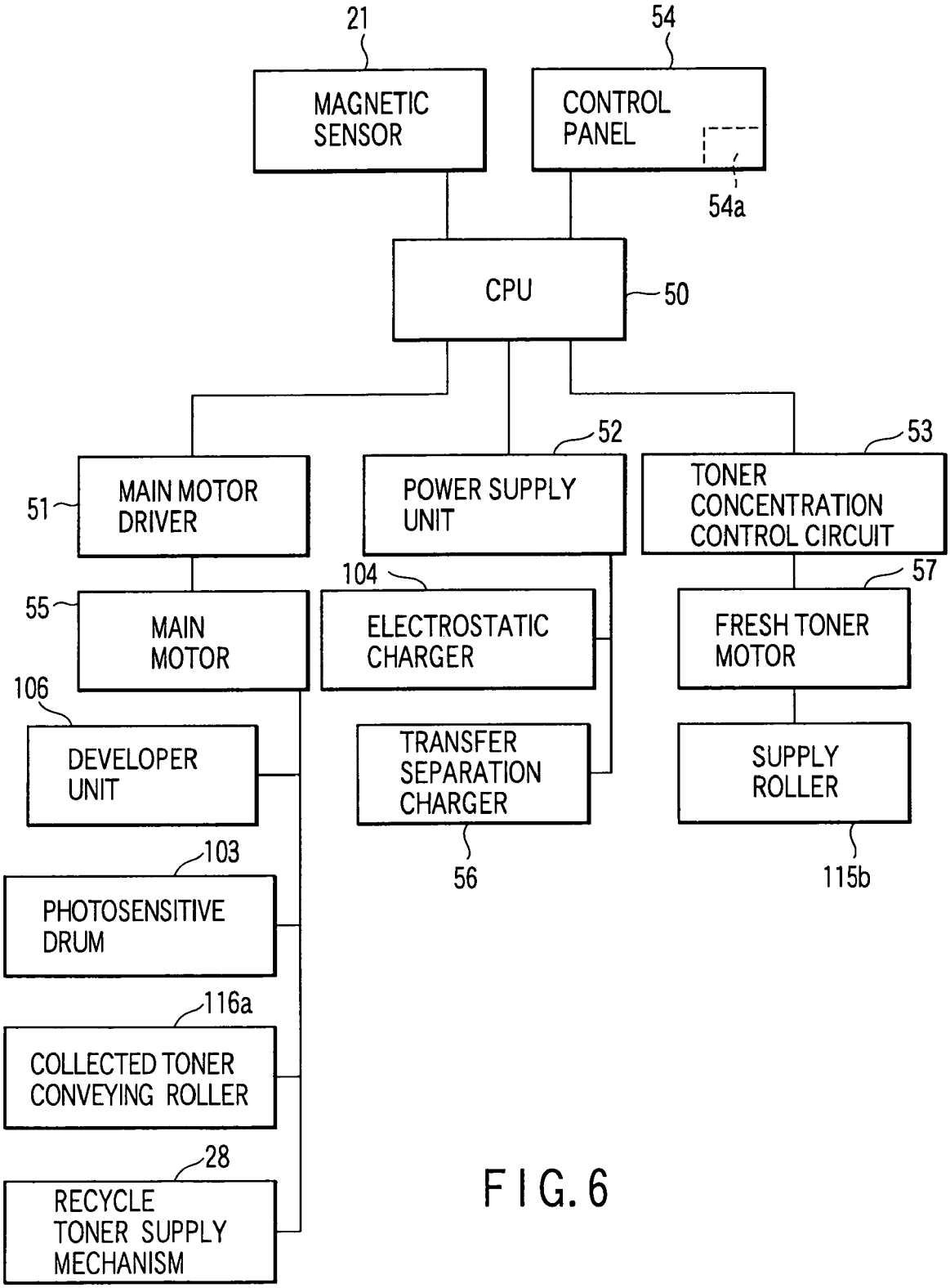

FIGS. 5A and 5B each are a diagram illustrating a mixer mounted in the developer unit shown in FIG. 2; and FIG. 6 is a block diagram illustrating the control system for the image forming unit shown in FIG. 1.

DETAILED DESCRIPTION OF THE INVENTION

An example of an image forming apparatus to which an embodiment of the present invention is applied will now be described with reference to accompanying drawings.

FIG. 1 schematically shows a front view of an image forming apparatus without its cover.

As shown in FIG. 1, an image forming apparatus (digital copying machine) 100 includes an image reading unit (scanner) 101 designed to read an image on an object (an original) to be read or copied and generate an image signal, and an image forming unit 102 designed to form an image based on the image signal output by the scanner 101 or an image signal provided from outside.

The image forming unit 102 includes a photosensitive drum 103, an electrostatic charger 104, an exposing unit 105, a developer unit 106, a paper-feeding cassette 107, a pickup roller 108, a conveying roller 109, an aligning roller 110, a transfer unit 111, a fuser 112, a paper feed-out roller 113, a paper output tray 114, a fresh toner supply unit 115 and a photosensitive drum cleaner 116.

The photosensitive drum 103 includes a photosensitive material on its external circumferential surface. When light is irradiated onto a region of the circumferential surface coated with the photosensitive material while a predetermined potential is applied thereto, the potential of the region irradiated with the light is varied. The variation of the potential can be maintained as an electrostatic image for a predetermined time on the surface.

The electrostatic charger 104 is designed to charge the surface of the photosensitive drum 103 to have a predetermined potential.

The exposing unit 105 is located on the downstream side of the charger 104 in the rotation direction of the photosensitive drum 103. The exposing unit 105 applies a laser beam LB onto the photosensitive drum 103, and the laser beam LB changes its light intensity in accordance with the image signal supplied from the scanner 101. Note that the laser beam LB is capable of having a predetermined light intensity in accordance with the density of the image, etc.

The developer unit 106 is located on the downstream side of the exposure unit 105 in the rotation direction of the photosensitive drum 103 and stores a two-component developer including a carrier and a toner. The developer unit 106 supplies the developer (for example, toner) onto the surface of the photosensitive drum 103. Thus, the latent image on the surface of the photosensitive drum 103 is visualized, and thus a toner image is formed.

The paper-feeding cassette 107 houses paper sheets Q, which are picked up one by one by the pickup roller 108. Each sheet Q is conveyed by the conveying roller 109 to the aligning roller 110.

The aligning roller 110 is designed to rotate at a predetermined timing so as to align the sheet Q with the position of the toner image formed on the photosensitive drum 103, and then convey the aligned sheet Q to the transfer position.

The transfer unit 111 applies a predetermined potential to the sheet Q to transfer the toner image on the photosensitive drum 103 onto the sheet Q.

The fuser 112 applies predetermined heat and pressure to the sheet Q on which the toner imager is held, and thus fixes the fused toner image onto the sheet Q.

The paper feed-out roller 113 conveys the sheet Q fed out from the fuser 112 to the paper output tray 114.

The fresh toner supply unit 115 supplies fresh toner, which has not been used for image formation, to the developer unit 106 at a predetermined timing.

The photosensitive drum cleaner 116 is located on the downstream side of the transfer position where the photosensitive drum 103 and the transfer unit 111 faces to each other, in the rotation direction of the photosensitive drum 103, and it serves to collect the toner and the like, attached to the surface of the photosensitive drum 103.

Figure 3:
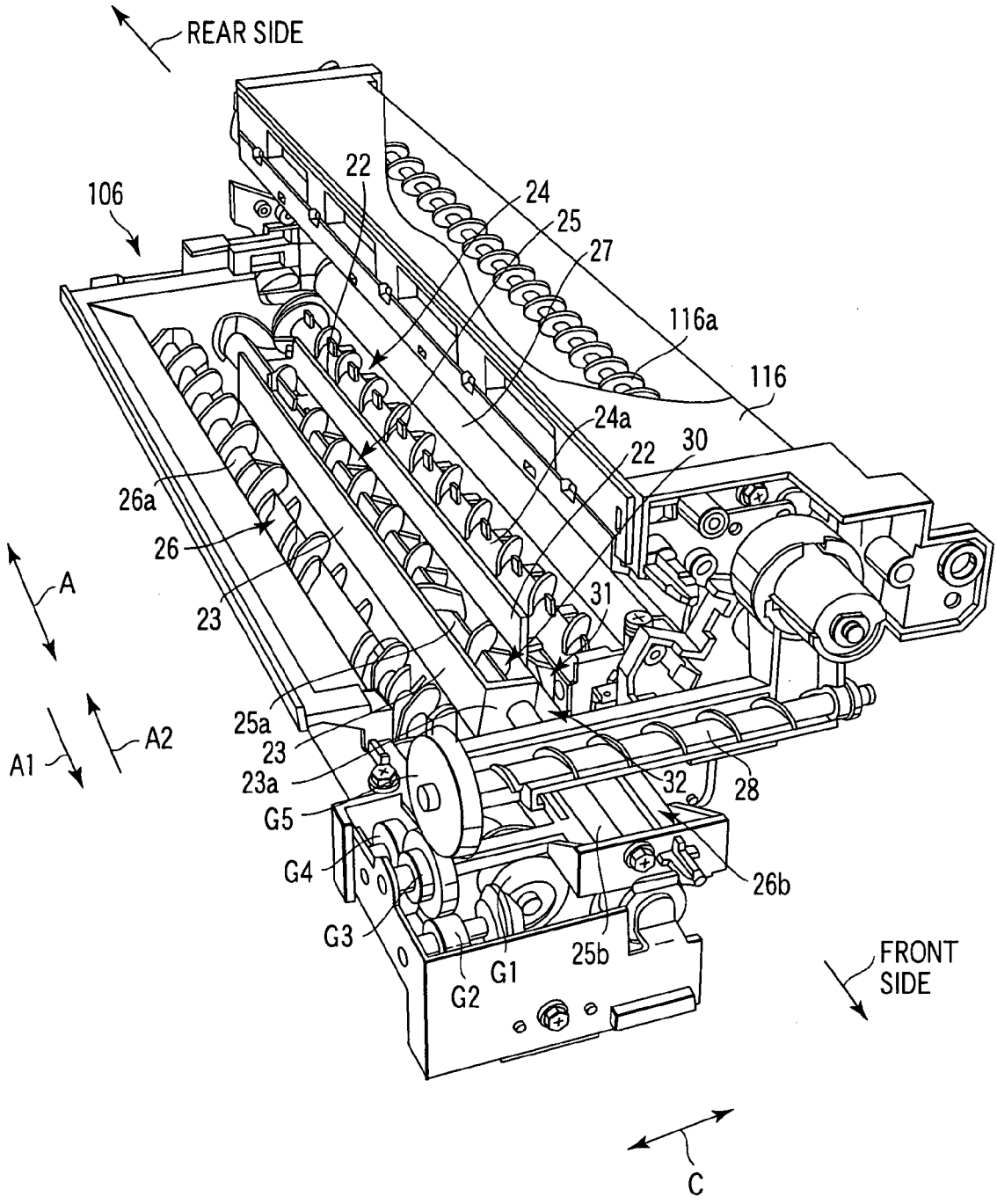
FIG. 3 is a diagram showing the developer unit shown in FIG. 2.
Figure 4:
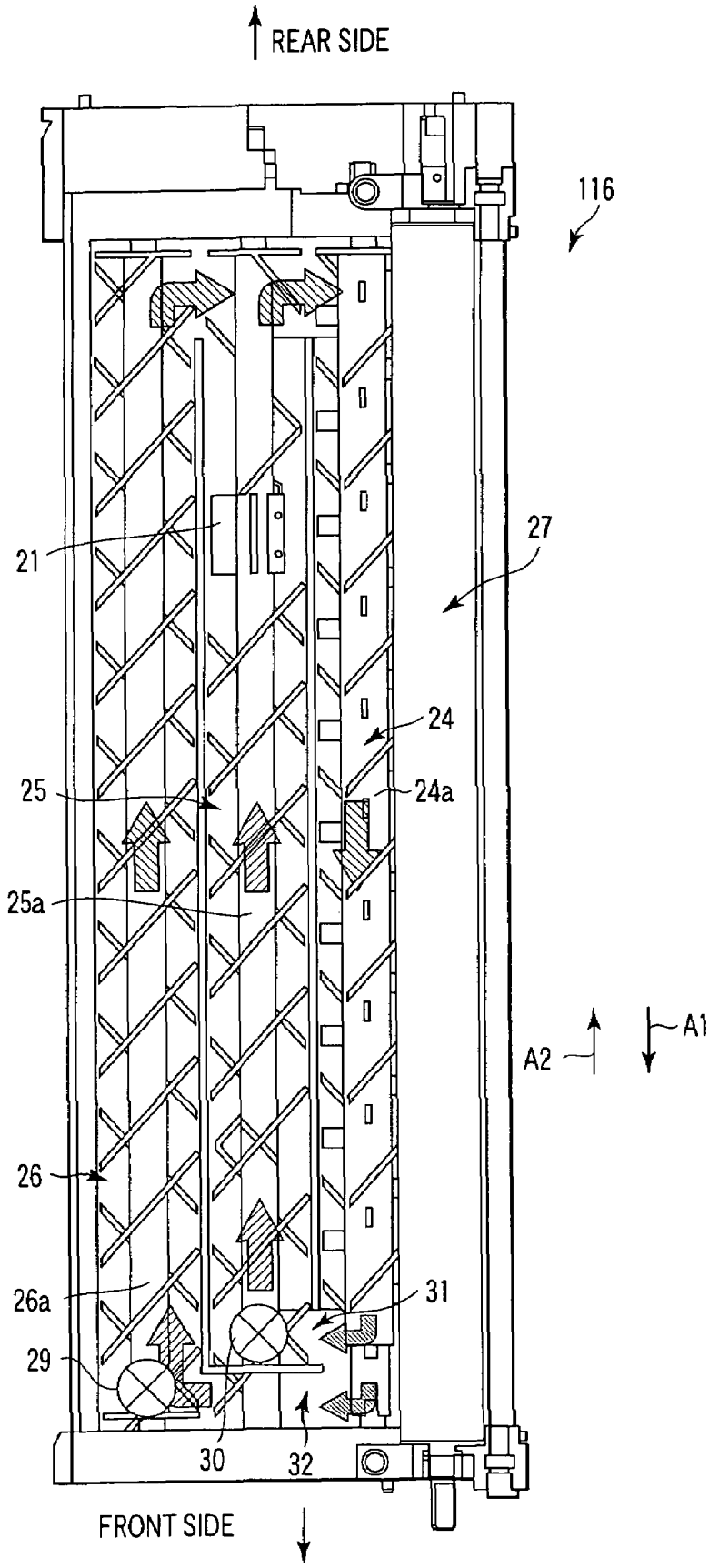
FIG. 4 is a schematic diagram illustrating the operation of the developer unit shown in FIG. 2.

FIG. 2 is a cross sectional view schematically showing a predetermined position in a front side of the developer unit in its longitudinal direction, and a vicinity of the end portion of the mixer. FIG. 3 is a perspective view of the developer unit. FIG. 4 is a schematic diagram of the developer unit shown in FIG. 2 when viewed from the direction indicated by arrow B in FIG. 2.

As shown in FIG. 2, the developer unit 106 includes the fresh toner supply unit 115, and is provided to face the photosensitive drum 103 at a predetermined position.

On the upstream side of the development position in the rotation direction, where the photosensitive drum 103 and the developer unit 106 face to each other, the electrostatic charger 104 and a de-electrification lamp 104*a* are arranged in this order. On the downstream side, the transfer unit 111 and the photosensitive drum cleaner 116 are arranged in this order.

The fresh toner supply device 115 includes a fresh toner cartridge 115*a* containing fresh toner and a supply roller 115*b* that rotates at a predetermined timing and supplies the fresh toner to a predetermined position of a second chamber 25.

The photosensitive drum cleaner 116 includes a collected toner conveying roller 116*a* that conveys collected recycle toner to the front side.

The developer unit 106 includes a developer container 20 that contains a two-component developer (to be called simply a developer) that consists of a carrier and toner, and a magnetic sensor 21 housed in the developer container 20 so as to detect the concentration of the toner. It is preferable that the magnetic sensor 21 is located at a predetermined position in a lower portion of the developer container 20.

The developer container 20 includes a first chamber 24, a second chamber 25 and a third chamber 26.

The first chamber 24 is equipped with a first mixer 24*a* having an axis parallel to an axial direction A (see FIG. 3) of the photosensitive drum 103, and it conveys the developer in the first direction to stir the carrier and toner, and applies a predetermined potential to the toner. The toner is supplied to the development position of the photosensitive drum 103 by a developer roller 27 provided to be rotatable.

The first mixer 24*a*, as it is rotated, conveys the developer in the first chamber 24 from a rear side to the front side, that is, in the first direction A1 (see FIG. 3) at a first speed while stirring the developer. In other words, the first mixer 24*a* supplies the developer received from the second mixer 25*a* and the third mixer 26*a*, which will be described later, to the developer roller 27 while stirring and conveying the developer. Further, the first mixer 24*a* receives the developer peeled off from the developer roller 27 after a development, and conveys.

The second chamber 25 is equipped with the second mixer 25*a* having an axis parallel to the axial direction A, and it conveys the developer in the second direction, which is different from the first direction, to stir the carrier and toner, and applies a predetermined potential to the toner. The second chamber 25 is separated from the first chamber 24 by a first partition 22. The first partition 22 has such a predetermined length that the first chamber 24 and second chamber 25 are connected by the rear side and front side. It should be noted that a first communicating portion 31 (see FIG. 4) that is connected to the downstream side of the first chamber 24 is located on the upstream side of the second chamber 25.

The second mixer 25*a*, as it is rotated, conveys the developer in the second chamber 25 from the front side to the rear side, that is, in the second direction A2 (see FIG. 3) at a second speed while stirring the developer. In other words, the second mixer 25*a* conveys the developer received from the first mixer 24*a* while stirring it, and then conveys the fresh toner received from the fresh toner supply unit 115 to first mixer 24*a* while stirring it with the developer and supplies the mixture to the first mixer 24*a*. The second speed may be the same as the first speed mentioned above.

The third chamber 26 is equipped with the third mixer 26*a* having an axis parallel to the axial direction A, and it conveys the developer in the second direction to stir the carrier and toner, and applies a predetermined potential to the toner. The third chamber 26 is separated from the second chamber 25 by a second partition 23. The second partition 23 has such a predetermined length that the second chamber 25 and third chamber 26 are connected by the rear side.

It should be noted that, as shown in FIG. 4, a second communicating portion 32 that is connected to the downstream side of the first chamber 24 is located on the upstream side of the third chamber 26, and thus the second communicating portion 32 is separated from the first communicating portion 31 by the second partition 23. That is, the second partition 23 has an L-letter shape.

The third mixer 26*a*, as it is rotated, conveys the developer in the third chamber 26 from the front side to the rear side, that is, in the second direction A2 (see FIG. 3) at a third speed while stirring the developer. The third speed may be at such a rate that can sufficiently arise the frictional charge on the recycle toner. In other words, the third mixer 26*a* conveys the recycle toner received from the recycle toner supply mechanism 28 while stirring it together with the developer, and then supplies the mixture to the second mixer 25*a*.

As shown in FIG. 3, the recycle toner supply mechanism 28 is provided on the front side of the developer unit 106, and the recycle toner supply mechanism 28 conveys the recycle toner supplied from the photosensitive drum cleaner 116, to a recycle toner supply portion 29 of the third chamber 26.

The recycle toner supply mechanism 28 is a mixer having a shaft directed, for example, to a certain direction with respect to the axial direction A of the photosensitive drum 103, that is, in the direction indicated by arrow C, and a helical blade formed on the shaft. As the mixer is rotated, the recycle toner can be conveyed.

It is preferable that the recycle toner supply portion 29 should be located on the front side of the third chamber 26, that is, the upstream side thereof but the downstream side of the second communicating portion 32.

Further, on the front side of the second chamber 25 (upstream side), that is, on the same side as the recycle toner supply portion 29, a fresh toner supply portion 30 to which fresh toner is supplied from the fresh toner supply unit 115 is located. It is preferable that the fresh toner supply portion 30 should be located on the downstream side of the first communicating portion 31.

FIGS. 5A and 5B are diagrams each illustrating a mixer mounted on the developer unit shown in FIG. 2.

The third mixer 26*a* has such a shape as of, for example, a mixer 40 shown in FIG. 5A, and the first and second mixers 24*a* and 25*a* have such a shape as of, for example, a mixer 50 shown in FIG. 5B.

As shown in FIG. 5A, the mixer 40 includes a forward conveying blade 41 that is rotated in a predetermined direction Y so as to convey the developer in a forward direction and a backward conveying blade 42 that is designed to convey the developer in a backward direction which is opposite to the forward direction.

Further, as shown in FIG. 5B, the mixer 50 includes a forward blade 51. As compared to the mixer 40, the developer can be conveyed in the forward direction in a shorter time. It should be noted that the mixer 40 can convey the developer at a predetermined speed in accordance with the ratio between the total areas of the forward conveying blade 41 and the backward conveying blade 42. Further, in order to change the speed in a further fine way, for example, forward conveying blades 41*a* and 41*b*, which have one half of the size of the forward conveying blade 41, or a forward conveying blade 41*c*, which has ⅔ of the size may be used to change the area of each blade, as shown in FIG. 5A.

With the above-described structure, if the third speed is slower than the first speed and second speed, for example, ½, ⅓ or ⅙ of the first speed and second speed, the degree of stirring of the developer in the third chamber 26 can be made higher than that in the first chamber 24 or second chamber 25. Thus, the degree of stirring of the recycle toner conveyed in the third chamber 26 can be made higher than that of the fresh toner. In this manner, it is possible to minimize the difference in charge level between the fresh toner and recycle toner.

It should be noted that as shown in FIG. 3, the recycle toner supply mechanism 28 is connected to a main motor 55 (see FIG. 6) via a gear G1 coupled with the rear side of the shaft of the third mixer 26*a*, gears G2, G3 and G4 coupled with the gear G1 and a gear G5 connected to an end of the central shaft of the supply mechanism 28 (see FIG. 3). With this structure, the recycle toner supply mechanism 28 can be rotated by a rotation force of the main motor 55. Although it is not illustrated in the figure, the gears G2, G3 and G4 should preferably be coupled with the photosensitive drum 103, the collected toner conveying roller 116*a*, the first to third mixers 24*a* to 26*a*, etc.

With the above-described structure, the photosensitive drum 103, the collected toner conveying roller 116*a*, the first to third mixers 24*a* to 26*a*, the recycle toner supply mechanism 28, etc., which are coupled with each other by means of the gears G1 to G5, can be rotated at the same time along with the rotation of the main motor 55.

Below the second chamber 25, the magnetic sensor 21 is provided on the downstream side of the fresh toner supply portion 30 in the moving direction of the developer. (See FIG. 4.)

FIG. 6 is a block diagram illustrating a control system for the image forming unit 102 shown in FIG. 1.

As shown in FIG. 6, a main motor driver 51, a power supply unit 52, a toner concentration control circuit 53, a control panel 54 and the magnetic sensor 21 are connected to a CPU 50.

The control panel 54 includes a display portion 54*a*, with which predetermined operations, for example, an instruction of scanning an image with the scanner 101, an instruction of forming an image with the image forming unit 102 or both instructions of scanning an image and forming an image, are input.

The magnetic sensor 21 detects the ratio between the carrier (for example, iron or ferrite) contained in the developer container 20 of the developer unit 106 and the toner (for example, resin) as the toner concentration, and outputs the detected value to the CPU 50. The CPU 50 compares the detected value of the toner concentration input from the magnetic sensor 21 with a predetermined reference value. When the detected value is lower than the reference value, a toner supply signal is output to the toner concentration control circuit 53. In more detail, the CPU 50 outputs the toner supply signal, which instruct to supply of toner, to the toner concentration control circuit 53 for a predetermined period of time in accordance with the level of the output voltage input from the magnetic sensor 21 to indicate the toner concentration.

The main motor driver 51 is connected to the main motor 55, and it outputs a drive signal when an instruction of forming an image is made via the control panel 54.

The main motor 55 is coupled with the first to third mixers 24*a* to 26*a* of the developing unit 106, the photosensitive drum 103, the collected toner conveying roller 116*a* and the recycle toner supply mechanism 28. When a drive signal is input from the main motor driver 51, the motor applies a predetermined driving force to these members.

The power supply unit 52 is connected to the electrostatic charger 104 and the transfer separation charger 56. When an instruction of scanning an image is made via the control panel 54, the power supply unit 52 outputs a predetermined voltage after a lapse of a certain period of time or immediately.

The electrostatic charger 104, when a predetermined voltage is applied from the power supply unit 52, discharges and thus applies a predetermined charge on the surface of the photosensitive drum 103.

The toner concentration control circuit 53 is connected to the fresh toner motor 57. When a toner supply signal is input from the CPU 50, the fresh toner motor 57 operates for a predetermined time period.

The fresh toner motor 57 adds a predetermined amount of fresh toner to the fresh toner supply portion 30 via the supply roller 115*b* operated by the toner concentration control circuit 53.

In other words, the amount of supply of fresh toner can be determined in accordance with the level of the toner concentration in the developer container 20. For example, when the toner concentration is very much decreased, the time for supplying the fresh toner becomes longer.

Next, the method of operating the image forming apparatus 100 will now be described. It should be noted first that the following embodiment will be described in connection with the case of an image formation carried out by the reversal development.

For example, when instructions of both of image scanning and image formation are made from the control panel 54, the scanner 101 starts scanning of the image and the image forming portion 102 makes the electrostatic charger 104 to discharge by the predetermined voltage output from the power supply unit 52. Further, at the same time, the image formation is instructed, and therefore the main motor driver 51 outputs a drive signal to the main motor 55.

The scanner 101 includes, for example, a light source, a lens and a charge coupling device (CCD). The scanner 101 forms an image of reflection light from an object to be copied, on the light receiving surface of the CCD by means of the lens, and obtains the image signal from the reflection light that is optoelectronically converted by the CCD. Thus obtained image signal is output to the exposure unit 105, where it is converted into a laser beam LB having a predetermined light intensity.

The laser beam LB is irradiated onto the surface of the photosensitive drum 103 that is uniformly charged at a negative charge by the electrostatic charger 104, and thus the potential at the portion irradiated with the laser beam LB becomes closer to zero. In other words, a latent image is formed on the surface of the photosensitive drum 103.

To the latent image section on the surface of the photosensitive drum 103, on which the laser beam LB has been irradiated to make it have a predetermined potential level, toner negatively charged by the developer unit 106 is attracted, and thus a toner image is formed.

The toner image is conveyed to the transfer position by the aligning roller 110, and then transferred onto a sheet Q that is charged at a positive charge by the transfer unit 111.

The toner image transferred onto the sheet Q is fused and fixed thereon by the fuser 112, and thus an image is formed on the sheet Q.

The sheet Q on which the image has been formed by the fuser 112 is fed out to the output tray 114 by the feed-out roller 113.

On the other hand, the portion of the toner that has not been transferred onto the sheet Q from the surface of the photosensitive drum 103, but has reached the photosensitive drum cleaner 116, is collected by the photosensitive drum cleaner 116.

The collected recycle toner is gathered by the collected toner conveying roller 116*a* to the front side, and then provided to the recycle toner supply portion 29 via the recycle toner supply mechanism 28, to be re-used as the recycle toner. On the other hand, a decrease in the toner concentration within the developer container 20 is detected by the magnetic sensor 21, the toner concentration control circuit 53 drives the fresh toner motor 57 for a predetermined time period (a predetermined number of times of rotation) to supply the fresh toner to the fresh toner supply portion 30.

Further, in the case where the toner concentration detected by the magnetic sensor 21 is not increased even if the toner concentration control circuit 53 outputs a drive signal for a predetermined time period or more to operate the supply roller 115*b*, the display portion 54*a* displays that the fresh toner in the fresh toner cartridge 115*a* has been used up to report the running out of toner to the user.

Next, the operation of the developer unit 116 will now be described with reference to FIG. 4.

When the instruction of the image formation (or image formation that includes an image scan) is input from the control panel 54, for example, the main motor driver 51 of the image forming portion 102 outputs a drive signal to the main motor 55.

When the drive signal is input from the main motor 55, the first to third mixers 24*a* to 26*a* and the developer roller 27 of the developer unit 106 are rotated in the predetermined directions at the predetermined speeds, respectively.

As the first mixer 24*a* is rotated, the developer in the first chamber 24 is moved in the first direction A1, and the developer thus conveyed to the downstream side goes through the first communicating portion 31 to reach the upstream of the second chamber 25. The developer that has reached the second chamber 25 is mixed with the fresh toner supplied from the fresh toner supply portion 30, and the mixture is moved in the second direction A2 to reach the upstream side of the first chamber 24 in the downstream side of the second chamber 25. As described, the developer containing at least the refresh toner is conveyed in the first conveying path made of the first chamber 24 and the second chamber 25, where the developer is stirred.

The developer thus conveyed to the downstream side by the first mixer 24*a* goes through the second communicating portion 32 to reach the upstream of the third chamber 26. The developer that has reached the third chamber 26 is mixed with the recycle toner supplied from the recycle toner supply portion 29, and the mixture is moved in the second direction and conveyed to the upstream side of the first chamber 24 in the downstream side of the third chamber 26. As described, the developer containing at least the recycle toner is conveyed in the second conveying path made of the first chamber 24 and the third chamber 26, where the developer is stirred. It should be noted here that the second conveying path includes the first chamber 24, which is also a part of the first conveying path.

In this manner, the developer conveyed to the upstream side of the first chamber 24 is stirred while it is conveyed in the first direction A1, and at the same time, it is guided onto the surface of the photosensitive drum 103 by the developer roller 27.

The second conveying path is longer than the first conveying path in length. Further, the conveying time period in the third chamber 26 is longer than those of the first and second chambers 24 or 25. Therefore, the speed of the developer conveyed in the second conveying path is slower than the speed of the developer conveyed in the first conveying path.

With the above-described structure, the recycle toner that is stirred in the third chamber 26 as it is conveyed there at the third speed is fully charged by friction (triboelectrification). Therefore, when the developer reaches the upstream side of the first chamber 24, the difference between the fresh toner and recycle toner in charge level can be minimized.

Meanwhile, the downstream portion of the first chamber 24 is connected to the first communicating portion 31 located on the upstream side of the second chamber 25 and to the second communicating portion 32 located on the upstream side of the third chamber 26, and the fresh toner supply portion 30 is located on the downstream side of the first communicating portion 31. With this structure, the flow of the fresh toner into the third chamber 26 can be prevented. In this manner, it is possible to avoid the reduction of the chance of contact between the recycle toner and the carrier in the developer, which is caused by supplying fresh toner to the third chamber 26 in which the developer from the first chamber 24, which has a lower toner ratio, and the recycle toner are stirred, which occurs during the operation of image formation. Therefore, the recycle toner supplied from the recycle toner supply portion 29 is sufficiently stirred and mixed in the third chamber 26. Thus, the supply of the developer containing insufficiently stirred recycle toner to the photosensitive drum 103 is suppressed, thereby making it possible to prevent the occurrences of errors including fogging in an image.

In the above-described embodiment, it is preferable that the two component developer in the developer container 20 should have a ratio of about 95% (by mass) of carrier and 5% (by mass) of toner. The ratio between the carrier and toner is detected by the magnetic sensor 21, and toner is supplied from the fresh toner supply unit 115 in accordance with the results of the detection.

What is claimed is:

1. An image forming apparatus comprising:

a first chamber including a first mixer and configured to convey a developer containing at least toner in a first direction while stirring the developer and supply the toner to an image carrier;

a second chamber including a second mixer and configured to convey at least the developer supplied from the first chamber in a second direction different from the first direction while stirring the developer;

a third chamber including a third mixer and configured to convey at least the developer supplied from the first chamber in the second direction while stirring the developer;

a fresh toner supply portion located on an upstream side of the second chamber and configured to receive fresh toner; and a recycle toner supply portion located on an upstream side of the third chamber and configured to receive recycle toner collected from a surface of the image carrier.

2. The image forming apparatus according to claim 1, wherein a downstream side of the first chamber is connected to a first communicating portion located on an upstream side of the second chamber and a second communicating portion located on an upstream side of the third chamber.

3. The image forming apparatus according to claim 2, wherein the first communicating portion is separated from the second communicating portion.

4. The image forming apparatus according to claim 3, wherein the fresh toner supply portion is located on a downstream side of the first communicating portion.

5. The image forming apparatus according to claim 1, further comprising:

a first conveying path including the first chamber and the second chamber, the second mixer conveying the developer containing the fresh toner at a first speed; and a second conveying path including the first chamber and the third chamber, the third mixer conveying the developer containing the recycle toner at a second speed which is slower than the first speed.

6. The image forming apparatus according to claim 5, wherein the second speed is one third of the first speed.

7. The image forming apparatus according to claim 5, wherein the second conveying path is longer than the first conveying path in length.

8. A toner stirring method comprising:

supplying recycle toner collected from a surface of an image carrier to a recycle toner supply portion;

conveying the supplied recycle toner to a merging portion at a first speed while stirring, thereby charging to have a predetermined potential;

conveying refresh toner supplied to a fresh toner supply portion at a predetermined timing to the merging portion at a second speed which is slower than the first speed while stirring, thereby charging to have a predetermined potential; and supplying the recycle toner and the fresh toner that have been conveyed to the merging portion to the surface of the image carrier.

9. The toner stirring method according to claim 8, the first speed is one third of the second speed.

* * * * *